US009650884B2

(12) United States Patent
Noske et al.

(10) Patent No.: US 9,650,884 B2
(45) Date of Patent: May 16, 2017

(54) USE OF DOWNHOLE ISOLATION VALVE TO SENSE ANNULUS PRESSURE

(71) Applicant: Weatherford Technology Holdings, LLC, Houston, TX (US)

(72) Inventors: Joe Noske, Houston, TX (US); Gary L. Mueller, Katy, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 738 days.

(21) Appl. No.: 14/032,866

(22) Filed: Sep. 20, 2013

(65) Prior Publication Data

US 2015/0083494 A1 Mar. 26, 2015

(51) Int. Cl.

| | |
|---|---|
| ***E21B 47/06*** | (2012.01) |
| ***E21B 21/10*** | (2006.01) |
| ***E21B 34/10*** | (2006.01) |
| ***E21B 21/08*** | (2006.01) |

(52) U.S. Cl.

CPC ..... *E21B 47/06* (2013.01); *E21B 21/08* (2013.01); *E21B 21/10* (2013.01); *E21B 34/10* (2013.01)

(58) Field of Classification Search

CPC ..... E21B 47/06; E21B 21/10; E21B 21/08; E21B 34/10; E21B 2034/005

See application file for complete search history.

(56) References Cited

U.S. PATENT DOCUMENTS

| | | | | |
|---|---|---|---|---|
| 6,644,110 | B1 | 11/2003 | Curtis et al. | |
| 6,766,703 | B1 | 7/2004 | Kluth et al. | |
| 7,350,590 | B2 | 4/2008 | Hosie et al. | |
| 7,451,809 | B2 | 11/2008 | Noske et al. | |
| 7,836,973 | B2 | 11/2010 | Belcher et al. | |
| 2004/0129424 | A1* | 7/2004 | Hosie | E21B 21/08 166/332.8 |
| 2006/0021757 | A1 | 2/2006 | Patel | |
| 2006/0076149 | A1 | 4/2006 | McCalvin | |
| 2006/0157282 | A1 | 7/2006 | Tilton et al. | |
| 2007/0084607 | A1 | 4/2007 | Wright et al. | |
| 2012/0067594 | A1 | 3/2012 | Noske et al. | |
| 2012/0234558 | A1 | 9/2012 | Godfrey et al. | |

FOREIGN PATENT DOCUMENTS

| | | | |
|---|---|---|---|
| EP | 1356186 | A1 | 10/2003 |
| EP | 1980711 | A2 | 10/2008 |

(Continued)

OTHER PUBLICATIONS

PCT International Search Report and Written Opinion dated Aug. 24, 2015, for International Application No. PCT/US2014/056573.

(Continued)

*Primary Examiner* — Yong-Suk (Philip) Ro

(74) *Attorney, Agent, or Firm* — Patterson & Sheridan, LLP

(57) ABSTRACT

A method of drilling a wellbore includes deploying a drill string into the wellbore through a casing string disposed in the wellbore. The casing string has a pressure responsive element and a hydraulic line in communication with the element and extending along the casing string. While drilling the formation, the method includes monitoring a pressure of the hydraulic line to ensure control of the formation.

20 Claims, 6 Drawing Sheets

(56) References Cited

FOREIGN PATENT DOCUMENTS

| | | |
|---|---|---|
| EP | 2053196 A1 | 4/2009 |
| GB | 2342669 A | 4/2000 |

OTHER PUBLICATIONS

PCT International Search Report and Written Opinion for Application PCT/US2014/056573, dated Feb. 3, 2015.
U.S. Appl. No. 13/965,380 Boutalbi filed on Aug. 14, 2012.
U.S. Appl. No. 14/150,137 Noske filed on Jan. 18, 2013.
Australian Patent Examination Report dated Jun. 7, 2016, for Australian Patent Application No. 2014321317.

* cited by examiner

USE OF DOWNHOLE ISOLATION VALVE TO SENSE ANNULUS PRESSURE

BACKGROUND OF THE DISCLOSURE

Field of the Disclosure

The present disclosure generally relates to use of a downhole isolation valve to sense annulus pressure.

Description of the Related Art

A wellbore is formed to access hydrocarbon bearing formations, e.g. crude oil and/or natural gas, by the use of drilling. Drilling is accomplished by utilizing a drill bit that is mounted on the end of a drill string. To drill the wellbore, the drill string is rotated by a top drive or rotary table on a surface platform or rig, and/or by a downhole motor mounted towards the lower end of the drill string. After drilling a first segment of the wellbore, the drill string and drill bit are removed and a section of casing is lowered into the wellbore. An annulus is thus formed between the string of casing and the formation. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

An isolation valve assembled as part of the casing string may be used to temporarily isolate a formation pressure below the isolation valve such that a drill or work string may be quickly and safely inserted into or removed from a portion of the wellbore above the isolation valve that is temporarily relieved to atmospheric pressure. Since the pressure above the isolation valve is relieved, the drill/work string can be tripped into the wellbore without wellbore pressure acting to push the string out and tripped out of the wellbore without concern for swabbing the exposed formation.

Once the first segment has been cased, the drill string may be redeployed into the wellbore to drill through the formation. During drilling through the formation, the well is controlled by maintaining a bottomhole pressure (BHP) greater than or equal to a pore pressure of the formation. If the BHP is allowed to decrease below the pore pressure, formation fluid will enter the wellbore. If the BHP exceeds fracture pressure of the formation, the formation will fracture and wellbore fluids may enter the formation. Conventionally, the BHP is estimated using standpipe and wellhead pressures measured at surface.

The influx of formation fluids into the wellbore is referred to as a kick. Kicks may occur for reasons, such as drilling through an abnormally high pressure formation, creating a swabbing effect when pulling the drill string out of the well for changing a bit, not replacing the drilling fluid displaced by the drill string when pulling the drill string out of the hole, and fluid loss into the formation resulting from overpressure thereof. A kick may be detected by drilling fluids flowing up through the annulus after pumping is stopped or by a sudden increase of the fluid level in the drilling fluid pit/tank. Because the formation fluid entering the wellbore ordinarily has a lower density than the drilling fluid, a kick will potentially reduce the hydrostatic pressure within the well and allow an accelerating influx of formation fluid. If not properly controlled, the kick may lead to a blowout which may result in the loss of the well, the drilling rig, and possibly the lives of those operating the rig.

SUMMARY OF THE DISCLOSURE

The present disclosure generally relates to use of a downhole isolation valve control line to sense annulus pressure. In one embodiment, a method of drilling a wellbore includes deploying a drill string into the wellbore through a casing string disposed in the wellbore. The casing string has a pressure responsive element and a hydraulic line in communication with the element and extending along the casing string. The method further includes: drilling the wellbore into a formation by injecting drilling fluid through the drill string and rotating a drill bit of the drill sting; and while drilling the formation, monitoring a pressure of the hydraulic line to ensure control of the formation.

In another embodiment, a system for use in drilling a wellbore includes an isolation valve. The isolation valve includes: a tubular housing for assembly as part of a casing string and for receiving a drill string; a flapper disposed in the housing and pivotable relative thereto between an open position and a closed position; a flow tube longitudinally movable relative to the housing for opening the flapper; a hydraulic chamber formed between the flow tube and the housing and receiving a piston of the flow tube; and a hydraulic passage in fluid communication with the chamber and a hydraulic coupling. The system further includes: a control line for connecting the hydraulic coupling to a hydraulic manifold; and a control station for operating the manifold and monitoring the control line and comprising a microcontroller (MCU) operable to calculate an annulus pressure using a pressure of the control line.

In another embodiment, a method of monitoring a wellbore operation includes deploying a tubular string into a wellbore through a casing string disposed in the wellbore. The casing string has a pressure responsive element and a hydraulic line in communication with the element and extending along the casing string. The method further includes, while deploying the tubular string, monitoring a pressure of the hydraulic line to ensure control of a formation exposed to the wellbore.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
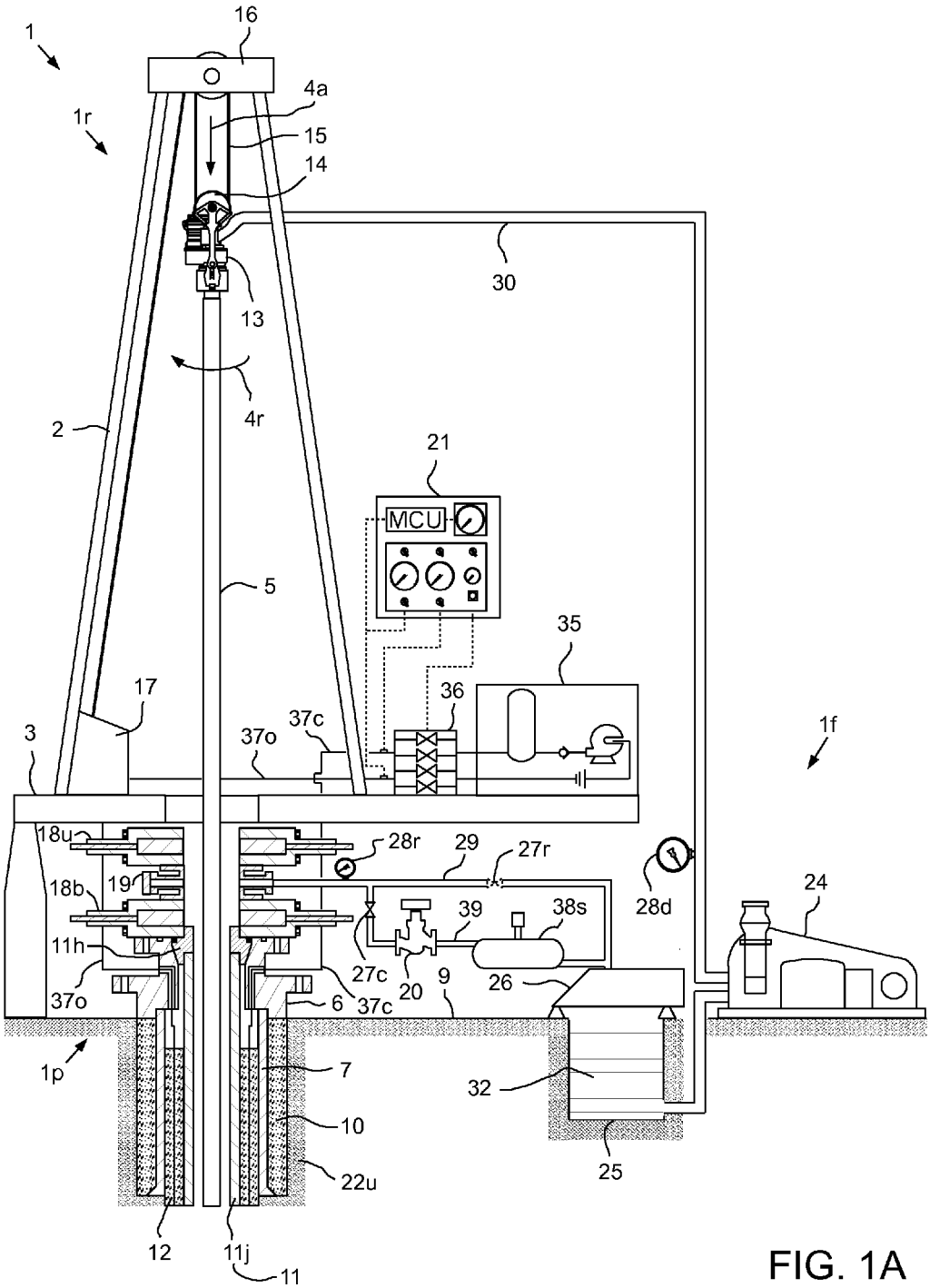
FIGS. 1A and 1B illustrate a terrestrial drilling system in a drilling mode, according to one embodiment of the present disclosure.
Figure 1B:
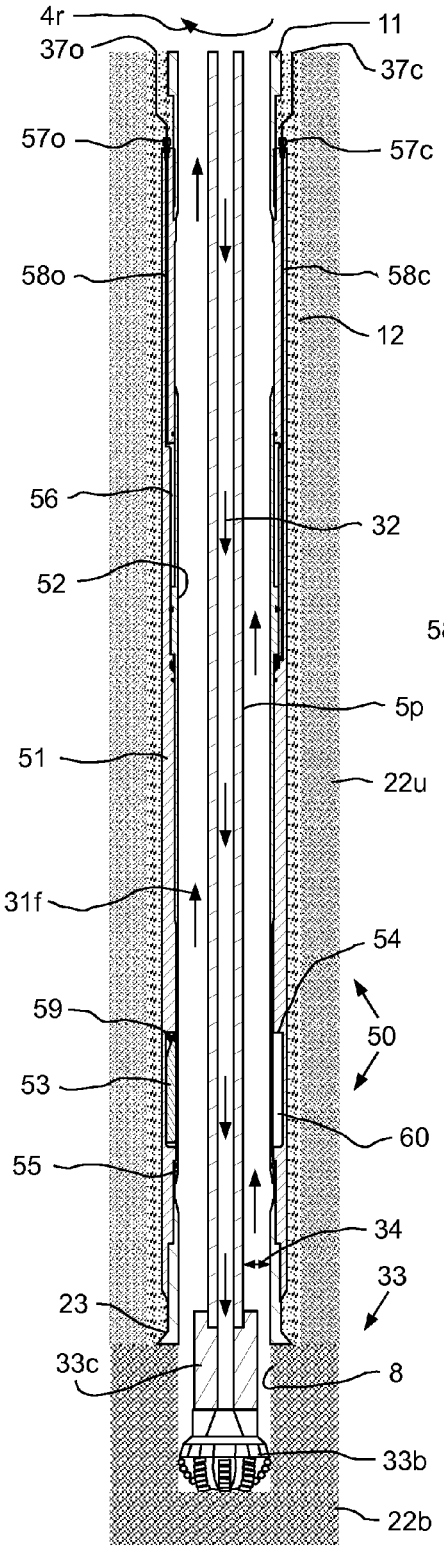

FIGS. 1A and 1B illustrate a terrestrial drilling system 1 in a drilling mode, according to one embodiment of the present disclosure. The drilling system 1 may include a drilling rig 1*r*, a fluid handling system 1*f*, a pressure control assembly (PCA) 1*p*, and a drill string 5. The drilling rig 1*r* may include a derrick 2 having a rig floor 3 at its lower end. The rig floor 3 may have an opening through which the drill string 5 extends downwardly into the PCA 1*p*. The drill string 5 may include a bottomhole assembly (BHA) 33 and a conveyor string. The conveyor string may include joints of drill pipe 5*p* connected together, such as by threaded couplings. The BHA 33 may be connected to the conveyor string, such as by threaded couplings, and include a drill bit 33*b* and one or more drill collars 33*c* connected thereto, such as by threaded couplings. The drill bit 33*b* may be rotated 4*r* by a top drive 13 via the conveyor string and/or the BHA 33 may further include a drilling motor (not shown) for rotating the drill bit. The BHA 33 may further include an instrumentation sub (not shown), such as a measurement while drilling (MWD) and/or a logging while drilling (LWD) sub.

An upper end of the drill string 5 may be connected to a quill of the top drive 13. The top drive 13 may include a motor for rotating 4*r* the drill string 5. The top drive motor may be electric or hydraulic. A frame of the top drive 13 may be coupled to a rail (not shown) of the derrick 2 for preventing rotation thereof during rotation of the drill string 5 and allowing for vertical movement of the top drive with a traveling block 14. The frame of the top drive 13 may be suspended from the derrick 2 by the traveling block 14. The traveling block 14 may be supported by wire rope 15 connected at its upper end to a crown block 16. The wire rope 15 may be woven through sheaves of the blocks 14, 16 and extend to drawworks 17 for reeling thereof, thereby raising or lowering 4*a* the traveling block 14 relative to the derrick 2.

The PCA 1*p* may include, one or more blow out preventers (BOPs) 18*u,b*, a flow cross 19, a variable choke valve 20, a control station 21, one or more shutoff valves 27*c,r*, one or more pressure gauges 28*d,r*, a hydraulic power unit (HPU) 35, a hydraulic manifold 36, one or more control lines 37*o,c*, a choke spool 39, and an isolation valve 50. A housing of each BOP 18*u,b* and the flow cross 19 may each be interconnected and/or connected to a wellhead 6, such as by a flanged connection.

The wellhead 6 may be mounted on an outer casing string 7 which has been deployed into a wellbore 8 drilled from a surface 9 of the earth and cemented 10 into the wellbore. An inner casing string 11 has been deployed into the wellbore 8, hung from the wellhead 6, and cemented 12 into place. The inner casing string 11 may extend to a depth adjacent a bottom of an upper formation 22*u*. The upper formation 22*u* may be non-productive and a lower formation 22*b* may be a hydrocarbon-bearing reservoir. The inner casing string 11 may include a casing hanger 11*h*, a plurality of casing joints 11*j* connected together, such as by threaded couplings, the isolation valve 50, and a guide shoe 23. The control lines 37*o,c* may extend from the manifold 36, through the wellhead 6, along an outer surface of the inner casing string 11, and to the isolation valve 50. The control lines 37*o,c* may be fastened to the inner casing string 11 at regular intervals.

Alternatively, the lower formation 22*b* may be non-productive (e.g., a depleted zone), environmentally sensitive, such as an aquifer, or unstable. Alternatively, the wellbore may be subsea having a wellhead located adjacent to the waterline and the drilling rig may be a located on a platform adjacent the wellhead. Alternatively, a Kelly and rotary table (not shown) may be used instead of the top drive.

The isolation valve 50 may include a tubular housing 51, an opener, such as a flow tube 52, a closure member, such as a flapper 53, a seat 54, and a receiver 55. To facilitate manufacturing and assembly, the housing 51 may include one or more sections (only one section shown) each connected together, such by threaded couplings and/or fasteners. Interfaces between the housing sections may be isolated, such as by seals. The housing sections may include an upper adapter (not shown) and a lower adapter (not shown), each having a threaded coupling, such as a pin or box, for connection to other members of the inner casing string 11. The isolation valve 50 may have a longitudinal bore therethrough for passage of the drill string 5. Although shown as part of the housing, the seat 54 may be a separate member connected to the housing 51, such as by threaded couplings and/or fasteners. The receiver 55 may be connected to the housing 51, such as by threaded couplings and/or fasteners.

The flow tube 52 may be disposed within the housing 51 and be longitudinally movable relative thereto between a lower position (shown) and an upper position (not shown). The flow tube 52 may have one or more portions (FIG. 2A), such as an upper sleeve 52*u*, a lower sleeve 52*b*, and a piston 52*p* connecting the upper and lower sleeves. The piston 52*p* may carry a seal for sealing an interface formed between an outer surface thereof and an inner surface of the housing 51. Alternatively, the flow tube portions 52*u,p,b* may be separate members interconnected, such as by threaded couplings and/or fasteners.

A hydraulic chamber 56 may be formed in an inner surface of the housing 51. The housing 51 may have shoulders formed in an inner surface thereof adjacent to the chamber 56. The housing 51 may carry an upper seal located adjacent to an upper shoulder and a lower seal and wiper located adjacent to the lower shoulder for isolating the chamber 56 from the bore of the isolation valve 50. The hydraulic chamber 56 may be defined radially between the flow tube 52 and the housing 51 and longitudinally between the upper and lower shoulders. Hydraulic fluid 61 (FIG. 2A) may be disposed in the chamber 56. The hydraulic fluid 61 may be an incompressible liquid, such as a water based mixture with glycol or a refined or synthetic oil. An upper end of the hydraulic chamber 56 may be in fluid communication with an opener hydraulic coupling 57*o* via an opener hydraulic passage 58*o* formed through a wall of the housing 51. A lower end of the hydraulic chamber 56 may be in fluid communication with a closer hydraulic coupling 57*c* via a closer hydraulic passage 58*c* formed through a wall of the housing 51.

The isolation valve 50 may further include a hinge 59. The flapper 53 may be pivotally connected to the seat 54 by the hinge 59. The flapper 53 may pivot about the hinge 59 between an open position (shown) and a closed position (not shown). The flapper 53 may be positioned below the seat 54 such that the flapper may open downwardly. The flapper 53 may have an undercut formed in at least a portion of an outer face thereof. The flapper undercut may facilitate engagement of an outer surface of the flapper 53 with a kickoff spring (not shown) connected to the housing 51, such as by a fastener. An inner periphery of the flapper 53 may engage a respective seating profile formed in an adjacent end of the seat 54 in the closed position, thereby isolating an upper portion of the valve bore from a lower portion of the valve bore. The interface between the flapper 53 and the seat 54 may be a metal to metal seal.

The hinge 59 may include a leaf, a knuckle of the flapper 53, one or more flapper springs, and a fastener, such as hinge pin, extending through holes of the flapper knuckle and a hole of each of one or more knuckles of the leaf. The seat 54 may have a recess formed in an outer surface thereof at an end adjacent to the flapper 53 for receiving the leaf. The leaf may be connected to the seat 54, such as by one or more fasteners.

The flapper 53 may be biased toward the closed position by the flapper springs, such as one or more inner and outer tension springs. Each tension spring may include a respective main portion and an extension. The seat 54 may have slots formed therethrough for receiving the flapper springs. An upper end of the main portions may be connected to the seat 54 at an end of the slots. The seat 54 may also have a guide path formed in an outer surface thereof for passage of the flapper springs to the flapper 53. Ends of the extensions may be connected to an inner face of the flapper 53. The kickoff spring may assist the tension springs in closing the flapper 53 due to the reduced lever arm of the spring tension when the flapper is in the open position.

Alternatively, the hinge may include a torsion spring instead of the tension springs and the kickoff spring. Alternatively, the leaf of the hinge 59 may be free to slide relative to the respective seat by a limited amount and a polymer seal ring may be disposed in a groove formed in the seating profile of the seat 54 such that the interface between the flapper inner periphery and the seating profile is a hybrid polymer and metal to metal seal. Alternatively, the seal ring may be disposed in the flapper inner periphery.

The flapper 53 may be opened and closed by interaction with the flow tube 52. Downward movement of the flow tube 52 may engage the lower sleeve 52*b* thereof with the flapper 53, thereby pushing and pivoting the flapper to the open position against the tension springs due to engagement of a bottom of the lower sleeve with an inner surface of the flapper. Upward movement of the flow tube 52 may disengage the lower sleeve 52*b* thereof with the flapper 53, thereby allowing the tension springs to pull and pivot the flapper to the closed position due to disengagement of the lower sleeve bottom from the inner surface of the flapper.

When the flow tube 52 is in the lower position, a flapper chamber 60 may be formed radially between the housing 51 and the flow tube and the (open) flapper 53 may be stowed in the flapper chamber. The flapper chamber 60 may be formed longitudinally between the seat 54 and the receiver 55. The flow tube bottom may be positioned adjacent to an upper end of the receiver 55, thereby closing the flapper chamber 60. The flapper chamber 60 may protect the flapper 53 from abrasion by the drill string 5 and from being eroded and/or fouled by cuttings in drilling returns 31*f*. The flapper 53 may have a curved shape to conform to the annular shape of the flapper chamber 60 and the seating profile of the flapper seat 54 may have a curved shape complementary to the flapper curvature.

Figure 3B:
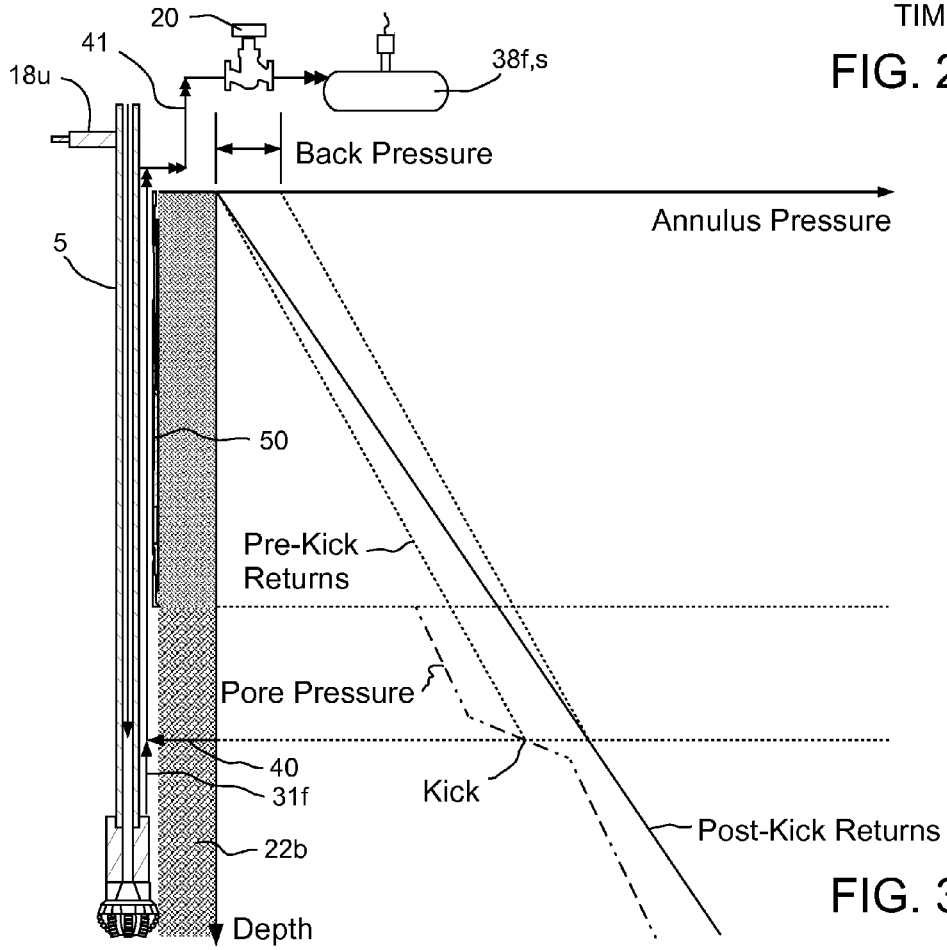
FIGS. 3A and 3B illustrate the drilling system in a well control mode.
Figure 3A:
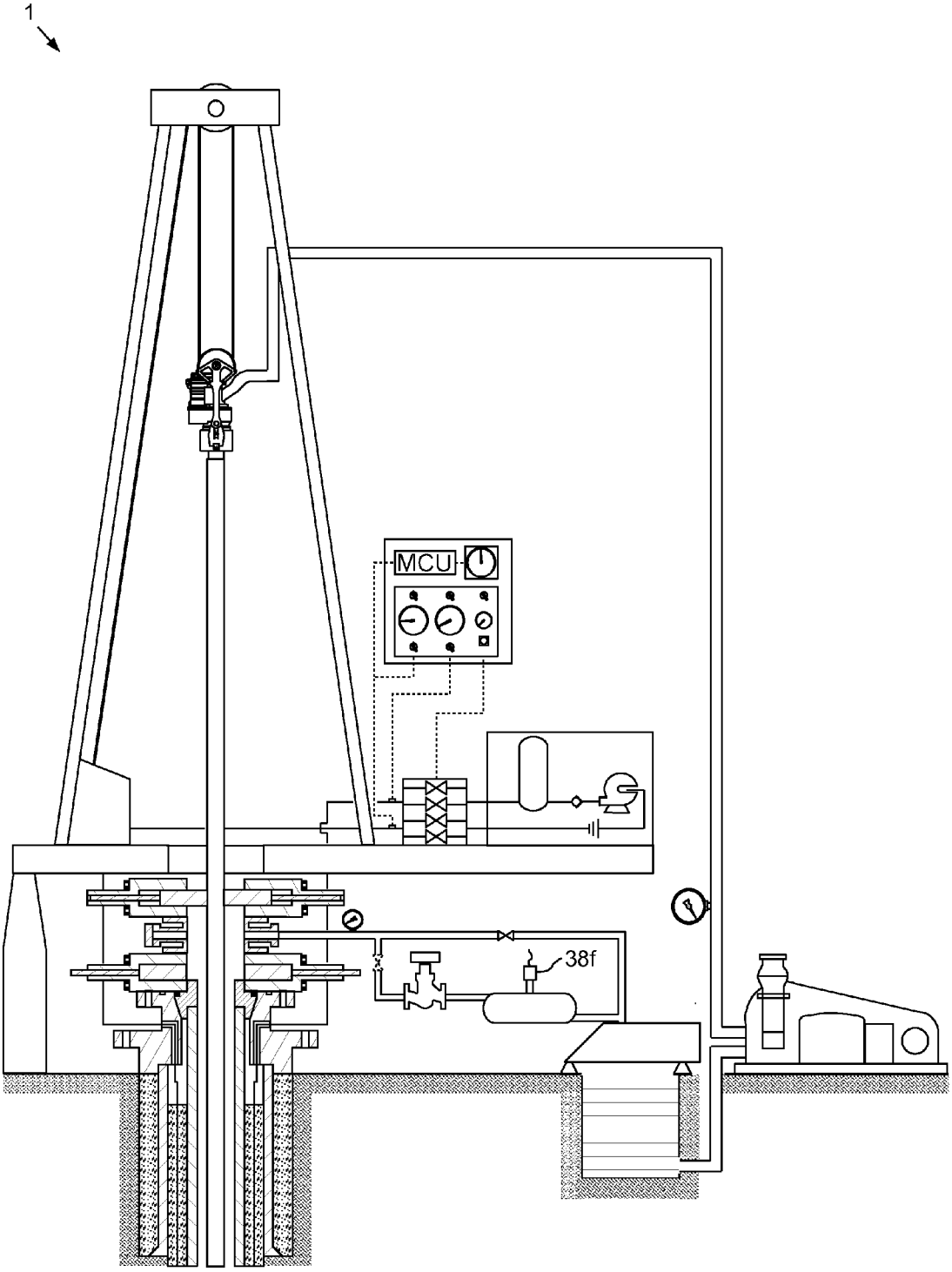

The fluid system if may include a mud pump 24, a drilling fluid reservoir, such as a pit 25 or tank, a solids separator, such as a shale shaker 26, a return line 29, a feed line, a supply line 30, a mud-gas separator (MGS) 38*s*, and a flare 38*f* (FIG. 3A). A first end of the return line 29 may be connected to a branch of the flow cross 19 and a second end of the return line may be connected to an inlet of the shaker 26. The returns pressure gauge 28*r* and returns shutoff valve 27*r* may be assembled as part of the return line 29. A first end of the choke spool 39 may be connected to the return line 29 between the returns pressure gauge 28*r* and the returns shutoff valve 27*r* and a second end of the choke spool may be connected to the shaker inlet. The choke shutoff valve 27*c*, choke valve 20, and MGS 38*s* may be assembled as part of the choke spool 39. The MGS 38*s* may include an inlet and a liquid outlet assembled as part of the choke spool 39 and a gas outlet connected to the flare 38*f* or a gas storage vessel (not shown).

A lower end of the supply line 30 may be connected to an outlet of the mud pump 24 and an upper end of the supply line may be connected to an inlet of the top drive 13. The supply pressure gauge 28*d* may be assembled as part of the supply line 30*p,h*. A lower end of the feed line may be connected to an outlet of the pit 25 and an upper end of the feed line may be connected to an inlet of the mud pump 24. The returns pressure gauge 28*r* may be operable to monitor wellhead pressure. The supply pressure gauge 28*d* may be operable to monitor standpipe pressure.

The drilling fluid 32 may include a base liquid. The base liquid may be refined or synthetic oil, water, brine, or a water/oil emulsion. The drilling fluid 32 may further include solids dissolved or suspended in the base liquid, such as organophilic clay, lignite, and/or asphalt, thereby forming a mud.

Once the inner casing string 11 has been deployed into the wellbore 8 and cemented into place, the drill string 5 may then be deployed into the wellbore until the drill bit 33*b* is adjacent to the guide shoe 23. The drilling fluid 32 may then be circulated into the wellbore to displace chaser fluid (not shown) from the annulus 34. Once the drilling fluid 32 has filled the annulus 34, circulation may be halted such that only hydrostatic pressure of the drilling fluid 32 is exerted on an inner surface of the upper sleeve 52*u* and hydrostatic pressure of the hydraulic fluid 61 is exerted on an outer surface of the upper sleeve 52*u*. If not already open, the technician may operate the control station 21 to place the opener control line 37*o* in fluid communication with a reservoir of the HPU 35 via the manifold 36. The technician may then operate the control station 21 to shut-in the opener line 37*o*, thereby hydraulically locking the piston 52*p* in place with the isolation valve 50 calibrated. The technician may then operate the control station 21 to place the closer line 37*c* in communication with an accumulator of the HPU 35 via the manifold 36 and then to shut in the closer line with an initial pressure.

Alternatively, the closer line 37*c* may be shut-in with no pressure or left open in fluid communication with the HPU reservoir. Alternatively, the opener line 37*o* may be shut in at surface before deployment of the inner casing string 11.

To extend the wellbore 8 from the casing shoe 23 into the lower formation 22*b*, the mud pump 24 may pump the drilling fluid 32 from the pit 25, through a standpipe and Kelly hose of the supply line 30 to the top drive 13. The drilling fluid 32 may flow from the supply line 30 and into the drill string 5 via the top drive 13. The drilling fluid 32 may be pumped down through the drill string 5 and exit the drill bit 33*b*, where the fluid may circulate the cuttings away from the bit and return the cuttings up an annulus 34 formed between an inner surface of the inner casing 11 or wellbore 8 and an outer surface of the drill string 10. The returns 31*f* (drilling fluid plus cuttings) may flow up the annulus 34 to the wellhead 6 and exit the wellhead at the flow cross 19. The returns 31*f* may continue through the return line 29 and into the shale shaker 26 and be processed thereby to remove the cuttings, thereby completing a cycle. As the drilling fluid 32 and returns 31*f* circulate, the drill string 5 may be rotated 4*r* by the top drive 13 and lowered 4*a* by the traveling block 14, thereby extending the wellbore 8 into the lower formation 22*b*.

Figure 2A:
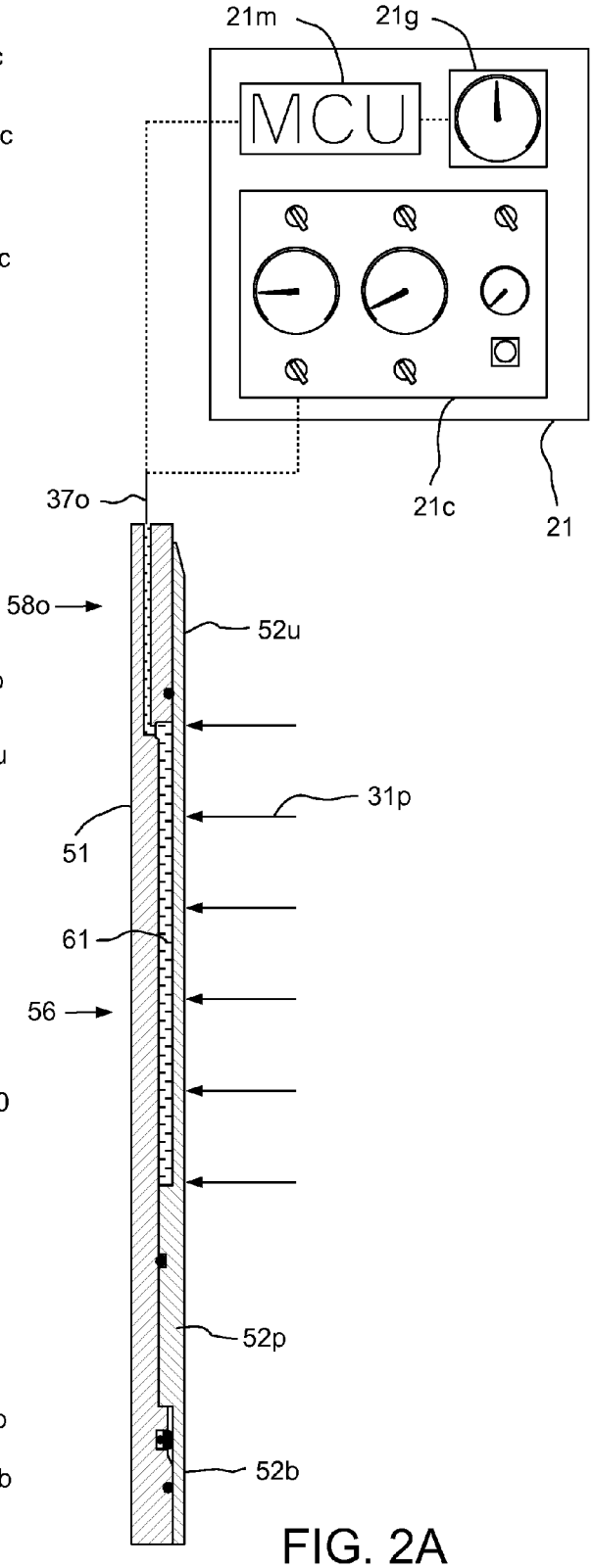
FIGS. 2A and 2B illustrate use of a downhole isolation valve of the drilling system to sense annulus pressure.
Figure 2B:
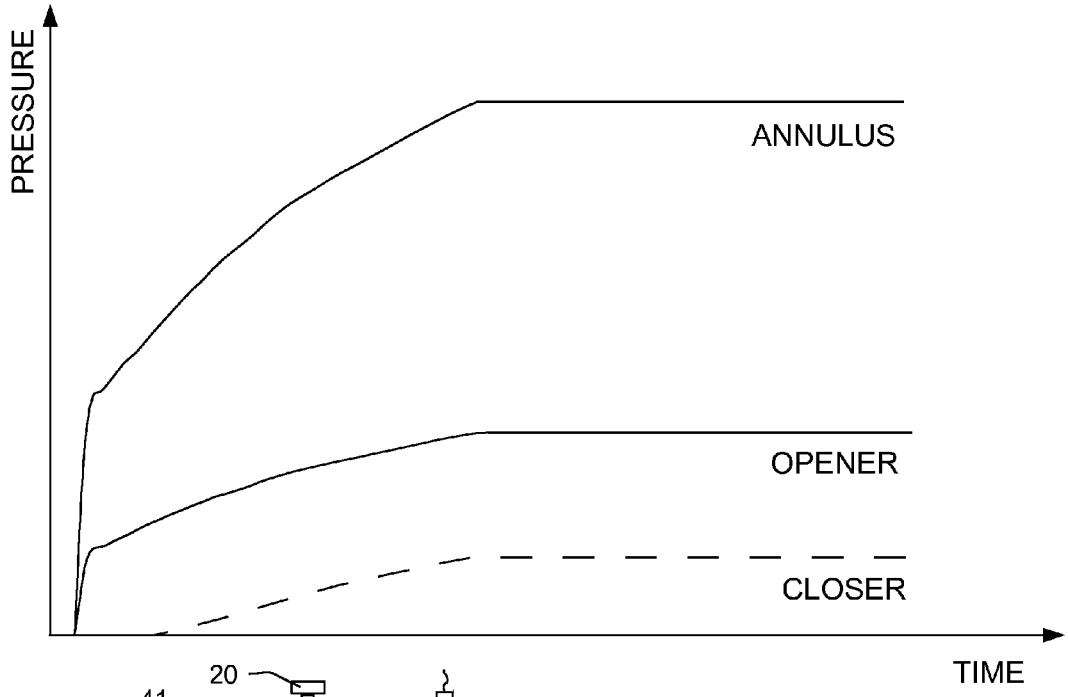

FIGS. 2A and 2B illustrate use of the isolation valve 50 to sense annulus pressure 31*p*. The control station 21 may include a console 21*c*, a microcontroller (MCU) 21*m*, and a display, such as a gauge 21*g*, in communication with the microcontroller 21*m*. The console 21*c* may be in communication with the manifold 36 and be in fluid communication with the control lines 37*o,c* via respective pressure taps. The console 21*c* may have controls for operation of the manifold 36 by the technician and have gauges for displaying pressures in the respective control lines for monitoring by the technician. The control station 21 may further include a pressure sensor (not shown) in fluid communication with the opener pressure tap and the MCU 21*m* may be in electrical communication with the pressure sensor to receive a pressure signal therefrom.

The housing 51, flow tube 52, and flapper 53 may each be made from a metal or alloy, such as steel, stainless steel, or nickel based alloy. The upper sleeve 52*u* may have a thin wall thickness imparting a relatively low stiffness to a span of the upper sleeve extending across the hydraulic chamber 56 when the flow tube 52 is in the lower position. Once drilling begins, the annulus pressure 31*p* may increase from the hydrostatic pressure of the drilling fluid 32 to a combination of the hydrostatic pressure and a dynamic pressure caused by friction loss of the returns 31*f* flowing up the annulus 34. The upper sleeve span may have a tendency to elastically deflect radially outward in response to the increase in annulus pressure 31*p* exerted on an inner surface thereof which may be restrained by the incompressible hydraulic fluid 61 disposed in the chamber (shut in by the manifold 36). The upper sleeve span may thus effectively serve as a diaphragm transferring at least a portion of the increased annulus pressure 31*p* to the hydraulic fluid 61 in the chamber 56. The transferred portion of the increased annulus pressure 31*p* may propagate through the hydraulic fluid 61 in the opener line 37*o* to the opener pressure tap of the control station 21.

The transferred portion of the increased annulus pressure 31*p* may be reflected on the opener gauge of the console 21*c* and detected by the MCU 21*m*. The MCU 21*m* may be programmed with a correlation between the transferred portion and the annulus pressure 31*p*. The correlation may include a hydrostatic portion and a dynamic portion. The hydrostatic correlation may be operable to query the technician for the density of the drilling fluid and the installation depth of the isolation valve 50 such that the MCU 21*m* may calculate the hydrostatic pressure of the drilling fluid 32.

The dynamic correlation may include a database of predefined values or a formula derived therefrom for various pressures exerted on the upper sleeve span and respective portions transferred to the hydraulic chamber 56. These values (or formula) may be calculated theoretically and/or measured empirically. If measured empirically, the isolation valve 50 may be laboratory and/or field tested for various pressures expected to occur during drilling of the lower formation 22*b*. The test may then be repeated to provide statistical samples. Statistical analysis may then be performed to exclude anomalies and/or derive a formula. The test may also be repeated for different models of isolation valves. If determined theoretically, parameters, such as flow tube diameter, wall thickness of the upper sleeve, span length, flow tube material, geometry of the hydraulic chamber, length of the opener line 37*o*, and hydraulic fluid type may be used to construct a computer model, such as a finite element and/or finite difference model, of the isolation valve 50 and then a simulation may be performed using the model to derive the values or a formula. The model may or may not be empirically adjusted.

If the isolation valve 50 was shut in with the initial pressure, the MCU 21*m* may subtract the initial pressure from the pressure sensor measurement to determine the actual transferred portion. The MCU 21*m* may then convert the transferred portion to the dynamic portion of the annulus pressure 31*p* using the dynamic correlation. The MCU 21*m* may then add the hydrostatic pressure of the drilling fluid 32 to the converted dynamic portion to calculate the annulus pressure 31*p*. The MCU 21*m* may then output the calculated annulus pressure to the gauge 21*g* for monitoring by the technician. The control station 21 may further include an alarm (not shown) operable by the MCU 21*m* for alerting the technician, such as a visual and/or audible alarm. The technician may enter one or more alarm set points into the control station 21 and the MCU 21*m* may alert the technician should the converted annulus pressure violate one of the set points.

The technician may periodically bleed the opener line 37*o* to account for thermal expansion of the hydraulic fluid 61 during drilling. The MCU 21*m* may include an override for the technician such that the bleeding of the opener line 37*o* does not trigger an alarm. Alternatively, the MCU 21*m* may record an initial pressure at the onset of drilling and be placed in communication with the manifold 36 to automatically bleed the opener line 37*o* to the initial pressure in response to a gradual pressure increase indicative of thermal expansion of the hydraulic fluid 61.

Alternatively, a pressure response of the closer line 37*c* may be used instead of or in addition to the pressure response of the opener line 37*o* to determine the annulus pressure 31*p*.

FIGS. 3A and 3B illustrate the drilling system 1 in a well control mode. During drilling of the lower formation 22*b*, the annulus pressure gauge 21*g* may be monitored by the technician and/or the MCU 21*m* may monitor the calculated annulus pressure directly for sudden changes indicative of a well control event, such as a kick or lost circulation. Since the isolation valve 50 is fixed in place, the annulus pressure 31*p* at that depth should remain relatively constant as the drill string 5 advances 4*a* into the lower formation 22*b*. A sudden increase in the calculated annulus pressure may indicate that formation fluid 40 has entered (aka kicked into) the annulus 34, thereby forming contaminated returns 41. A sudden decrease in the calculated annulus pressure may indicate that the returns 31*f* have entered the lower formation 22*b* due to fracture thereof which may then result in a kick if a sufficient amount of the returns is lost.

Alternatively, the MCU gauge 21*g* may be omitted and the MCU may monitor the transferred portion of the increased annulus pressure without calculating the annulus pressure. Alternatively, the MCU 21*m* and associated gauge 21*g* may be omitted and the technician may monitor the console opener gauge for indication of the well control event.

Since the isolation valve 50 may be located adjacent to a bottom of the inner casing string 11, the distance between the isolation valve and the lower formation 22*b* may be substantially less than the depth of the lower formation from the surface 9. This proximity may improve accuracy of the calculated annulus pressure when compared to prior art well control techniques relying on parameters measured at the surface 9. Further, since the annulus pressure 31*p* may be measured during drilling (aka real time), the latency resulting from prior art techniques that require halting drilling is eliminated.

To shift the drilling system 1 to the well control mode in response to a detected kick, the driller may halt advancement of the drill string 5 by the draw works 17 and halt rotation 4*r* of the drill string 5 by the top drive 13. The top drive 5 may also be raised to remove weight on the bit 33*b*. The driller may then close the upper BOP 18*u* against an outer surface of the drill pipe 5*p*. The driller may open the choke shutoff valve 38*b* and close the return shutoff valve 27*r*, thereby diverting flow of the returns 31*f* through the choke line 39. The choke 20 may be set to exert sufficient back pressure to control the kick and the MGS 38*s* may degas the contaminated returns 41 and a liquid portion thereof may be discharged into the shale shaker 33. The shale shaker 33 may process the contaminated liquid portion to remove the cuttings and the processed contaminated liquid portion may be diverted into a disposal tank (not shown). The gas portion of the contaminated returns 41 may be discharged to the flare 38*f*.

Using the calculated annulus pressure, the driller may determine a pore pressure gradient necessary to control the kick and a density of the drilling fluid 32 may be increased to correspond to the determined pore pressure gradient. The increased density drilling fluid may be pumped into the drill string 5 until the annulus 34 is full of the heavier drilling fluid. The drilling system 1 may then be shifted back to drilling mode and drilling of the wellbore 8 through the lower formation 22*b* may continue with the heavier drilling fluid such that the returns 64*r* therefrom maintain at least a balanced condition in the annulus 34.

If the well control event detected is lost circulation, the drilling system 1 may be shifted into well control mode; however, a flow rate of the mud pump 24 may be decreased to alleviate overpressure of the lower formation 22*b* instead of diverting the returns 31*f* into the choke line 39. The calculated annulus pressure may be used to decrease a density of the drilling fluid 32 for continued drilling through the lower formation 22*b*.

After drilling of the lower formation 22*b* to total depth, the drill string 5 may be raised to such that the drill bit 33*b* is above the flapper 53. The technician may then operate the control station 21 to supply pressurized hydraulic fluid 61 from the HPU accumulator to the closer passage 58*c* and to relieve hydraulic fluid from the opener passage 58*o* to the HPU reservoir. The pressurized hydraulic fluid 61 may flow from the manifold 36 through the wellhead 6 and into the wellbore via closer line 37*c*. The pressurized hydraulic fluid 61 may flow down the closer line 37*c* and into the closer passage 58*c* via the hydraulic coupling 57*c*. The hydraulic fluid 61 may exit the passage 58*c* into the hydraulic chamber lower portion and exert pressure on a lower face of the piston 52*p*, thereby driving the piston upwardly relative to the housing 51.

Alternatively, the drill string 5 may need to be removed for other reasons before reaching total depth, such as for replacement of the drill bit 33*b*.

As the piston 52*p* begins to travel, hydraulic fluid 61 displaced from the hydraulic chamber upper portion may flow through the opener passage 58*o* and into the opener line 37*o* via the hydraulic coupling 570. The displaced hydraulic fluid 61 may flow up the opener line 37*o*, through the wellhead 6, and exit the opener line into the hydraulic manifold 36. As the piston 52*p* travels and the lower sleeve 52*b* clears the flapper 53, the tension springs may close the flapper. Movement of the piston 52*p* may be halted by abutment of an upper face thereof with the upper housing shoulder. Once the flapper 53 has closed, the technician may then operate the control station 21 to shut-in the closer line 37*c* or both of the control lines 37*o,c*, thereby hydraulically locking the piston 52*p* in place. Drilling fluid 32 may be circulated (or continue to be circulated) in an upper portion of the wellbore 8 (above the lower flapper) to wash an upper portion of the isolation valve 50. The drill string 5 may then be retrieved to the rig 1*r*.

If total depth has not been reached, the drill bit 33*b* may be replaced and the drill string 5 may be redeployed into the wellbore 8. Pressure in the upper portion of the wellbore 8 may then be equalized with pressure in the lower portion of the wellbore 8. The technician may then operate the control station 21 to supply pressurized hydraulic fluid to the opener line 37*o* while relieving the closer line 37*c*, thereby opening the flapper 53. Once the flapper 53 has been opened, the technician may then operate the control station 21 to shut-in the opener line 37*c* or both of the control lines 37*o,c*, thereby hydraulically locking the piston 52*p* in place. Drilling may then resume. In this manner, the lower formation 22*b* may remain live during tripping due to isolation from the upper portion of the wellbore 8 by the closed isolation valve 50, thereby obviating the need to kill the lower formation 22*b*.

Once drilling has reached total depth, the drill string 5 may be retrieved to the drilling rig 1*r*, as discussed above. A liner string (not shown) may then be deployed into the wellbore 8 using a work string (not shown). The liner string and workstring may be deployed into the live wellbore 8 using the isolation valve 50, as discussed above for the drill string 5. Once deployed, the liner string may be set in the wellbore 8 using the workstring. The work string may then be retrieved from the wellbore 8 using the isolation valve 50 as discussed above for the drill string 5. The PCA 1*p* may then be removed from the wellhead 6. A production tubing string (not shown) may be deployed into the wellbore 8 and a production tree (not shown) may then be installed on the wellhead 6. Hydrocarbons (not shown) produced from the lower formation 22*b* may enter a bore of the liner, travel through the liner bore, and enter a bore of the production tubing for transport to the surface 9.

Additionally, the calculated annulus pressure may be monitored by the technician while: tripping the drill string 5 into/from the wellbore 8, adding joints or stands to the drill string 5 during drilling, deploying and/or setting the liner string into the wellbore, or during any kind of other wellbore operation using any kind of tubular string.

Figure 4:
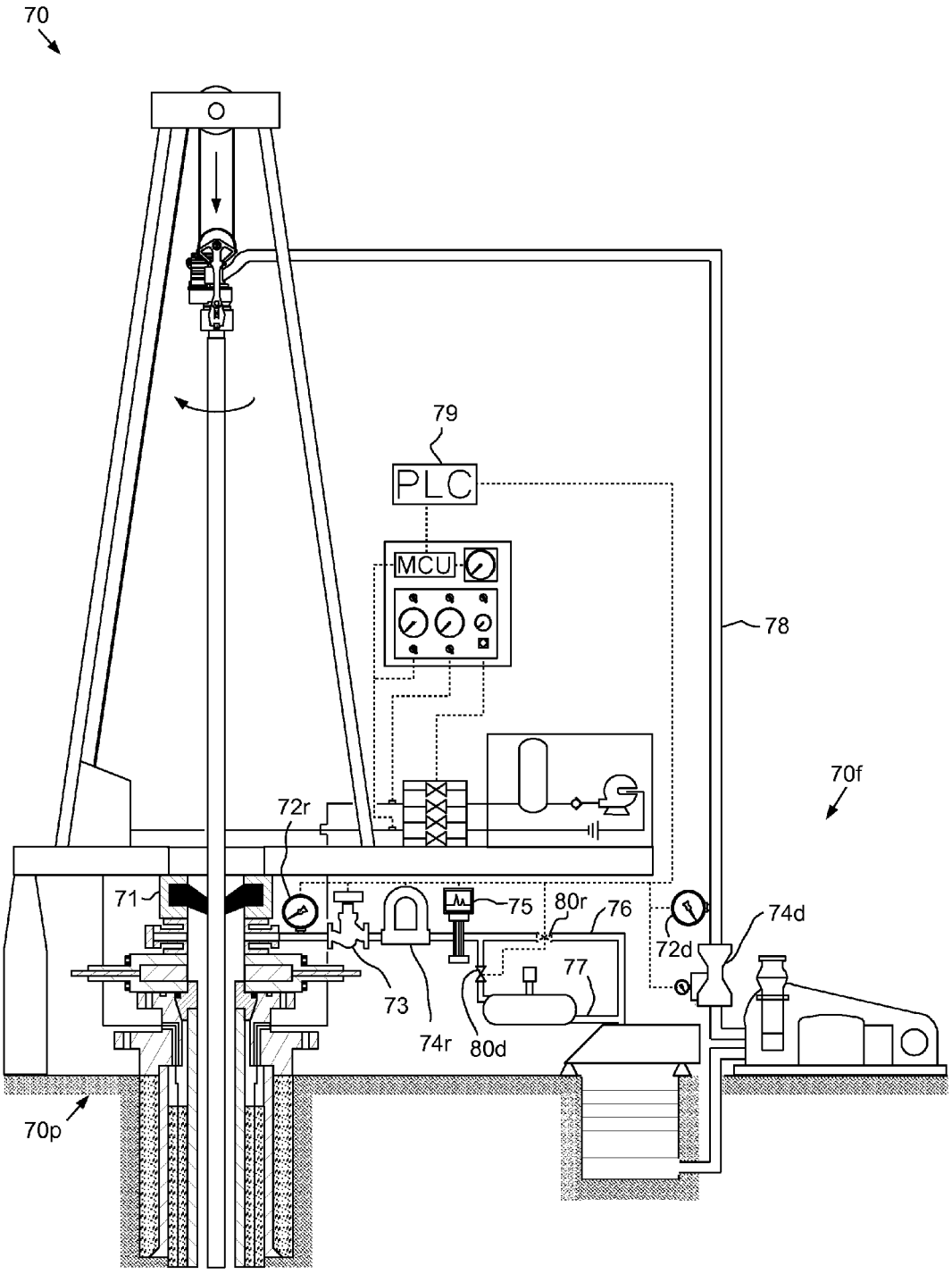
FIG. 4 illustrates a closed loop drilling system in a drilling mode, according to another embodiment of the present disclosure.

FIG. 4 illustrates a closed loop drilling system 70 in a drilling mode according to another embodiment of the present disclosure. The drilling system 70 may include the drilling rig 1*r*, a fluid handling system 70*f*, a pressure control assembly (PCA) 70*p*, and the drill string 5. The PCA 70*p* may include the BOP 18*b*, a rotating control device (RCD) 71, one or more pressure sensors 72*d,r*, an automated variable choke valve 73, one or more flow meters 74*d,r*, a gas detector 75, the control station 21, the HPU 35, the hydraulic manifold 36, the control lines 37*o,c*, the isolation valve 50, a programmable logic controller (PLC) 79, and one or more automated shutoff valves 80*d,r*. A housing of the BOP 18*b* and a housing of the RCD 71 may each be interconnected and/or connected to the wellhead 6, such as by a flanged connection.

The RCD 71 may include a stripper seal and the housing. The stripper seal may be supported for rotation relative to the housing by bearings. The stripper seal-housing interface may be isolated by seals. The stripper seal may form an interference fit with an outer surface of the drill string 5 and be directional for augmentation by wellbore pressure. The stripper seal may rotate with the drill string 5 during drilling of the lower formation. The gas detector 75 may include a probe having a membrane for sampling gas from the returns 31*f*, a gas chromatograph, and a carrier system for delivering the gas sample to the chromatograph.

The automated choke 73 include a hydraulic actuator operated by the PLC 79 via a second hydraulic power unit (HPU) (not shown) to maintain backpressure in the wellhead 6. Each automated shutoff valve 80*d,r* may include a hydraulic actuator operated by the PLC 79 via the second HPU. Alternatively, the valve actuators may each be pneumatic or electric.

The fluid system 70*f* may include the mud pump 24, the pit 25, the MGS 38*s*, the flare 38*f*, the shale shaker 26, a return flow line 76, a degassing spool 77, the feed flow line, and a supply flow line 78. A first end of the return line 76 may be connected to the RCD outlet and a second end of the return line may be connected to the shaker inlet. The returns pressure sensor 72*r*, choke 73, returns flow meter 74*r*, gas detector 75, and returns shutoff valve 80*r* may be assembled as part of the return line 76. The degassing shutoff valve 80*d* and MGS 38*s* may be assembled as part of the degassing spool 77. A lower end of the supply line 78 may be connected to the mud pump outlet and an upper end of the supply line may be connected to the top drive inlet. The supply pressure sensor 72*d* and supply flow meter 74*d* may be assembled as part of the supply line 78.

Each pressure sensor 72*d,r* may be in data communication with the PLC 79. The returns pressure sensor 72*r* may be connected between the choke 73 and the RCD outlet and may be operable to monitor wellhead pressure. The supply pressure sensor 72*d* may be connected between the mud pump 24 and a Kelly hose of the supply line 78 and may be operable to monitor standpipe pressure. The returns 74*r* flow meter may be a mass flow meter, such as a Coriolis flow meter, and may be in data communication with the PLC 79. The returns flow meter 74*r* may be connected between the choke 73 and the shale shaker 26 and may be operable to monitor a flow rate of drilling returns 31*f*. The supply 74*d* flow meter may be a volumetric flow meter, such as a Venturi flow meter, and may be in data communication with the PLC 79. The supply flow meter 74*d* may be connected between the mud pump 24 and the Kelly hose and may be operable to monitor a flow rate of the mud pump. The PLC 79 may receive a density measurement of drilling fluid 32 from a mud blender (not shown) to determine a mass flow rate of the drilling fluid from the volumetric measurement of the supply flow meter 74*d*. The MCU 21*m* may be in data communication with the PLC 79 via a data cable or wireless link.

Alternatively, a stroke counter (not shown) may be used to monitor a flow rate of the mud pump instead of the supply flow meter. Alternatively, the supply flow meter may be a mass flow meter.

To extend the wellbore 8 from the casing shoe 23 into the lower formation 22*b*, the mud pump 24 may pump the drilling fluid 32 from the pit 25, through the supply line 78 to the top drive 13. The drilling fluid 32 may flow from the supply line 78 and into the drill string 5 via the top drive 13. The drilling fluid 32 may be pumped down through the drill string 5 and exit the drill bit 33*b*, where the fluid may circulate the cuttings away from the bit and return the cuttings up the annulus 34. The returns 31*f* may flow up the annulus 34 to the wellhead 6 and be diverted by the RCD 71 into the RCD outlet. The returns 31*f* may continue through the choke 73 and the flow meter 74*r*. The returns 31*f* may then flow into the shale shaker 26 and be processed thereby to remove the cuttings, thereby completing a cycle. As the drilling fluid 32 and returns 31 circulate, the drill string 5 may be rotated 4*r* by the top drive 13 and lowered 4*a* by the traveling block 14, thereby extending the wellbore 8 into the lower formation 22*b*.

Alternatively, the drilling fluid 32 may further include a gas, such as diatomic nitrogen mixed with the base liquid, thereby forming a two-phase mixture. Alternatively, the drilling fluid may be a gas, such as nitrogen, or gaseous, such as a mist or foam. If the drilling fluid 32 includes gas, the drilling system 70 may further include a nitrogen production unit (not shown) operable to produce commercially pure nitrogen from air. Alternatively, the degassing spool 77 may be online during drilling of the lower formation.

A static density of the drilling fluid 32 may correspond to a pore pressure gradient of the lower formation 22*b*. The PLC 79 may be programmed to operate the choke 73 such that a target bottomhole pressure (BHP) is maintained in the annulus 34 during the drilling operation. The target BHP may correspond to the pore pressure of the lower formation 22*b* such that an underbalanced, balanced, or slightly overbalanced condition is maintained during drilling of the lower formation 22*b*. During the drilling operation, the PLC 79 may receive the calculated annulus pressure from the MCU 21*m* and execute a real time simulation of the drilling operation in order to predict the actual BHP using the calculated annulus pressure and other parameters, such as standpipe pressure from sensor 28*d*, mud pump flow rate from flow meter 74*d*, and returns flow rate from flow meter 74*r*. The PLC 79 may then compare the predicted BHP to the target BHP and adjust the MP choke 36*a* accordingly.

During the drilling operation, the PLC 79 may also perform a mass balance to ensure control of the lower formation 22*b*. As the drilling fluid 32 is being pumped into the wellbore 8 by the mud pump 24 and the returns 31*f* are being received from the return line 76, the PLC 79 may compare the mass flow rates (i.e., drilling fluid flow rate minus returns flow rate) using the respective flow meters 74*d,r*. The PLC 79 may use the mass balance to monitor for the formation fluid 40 entering the annulus 34 (some ingress may be tolerated for underbalanced drilling) and contaminating the returns 41 or returns 31*f* entering the formation 22*b*. The gas detector 75 may also capture and analyze samples of the returns 31*f* as an additional safeguard for kick detection.

Upon detection of a kick or lost circulation, the PLC 79 may take remedial action, such as diverting the flow of returns 31*f*/41 to the degassing spool 77. The PLC 79 may also adjust the choke 73 accordingly using the calculated annulus pressure from the MCU 21*m*, such as tightening the choke in response to a kick and loosening the choke in response to loss of the returns.

Alternatively, the flow meters 74*d,r* may be omitted and the converted annulus pressure used to detect the well control event.

Figure 5:
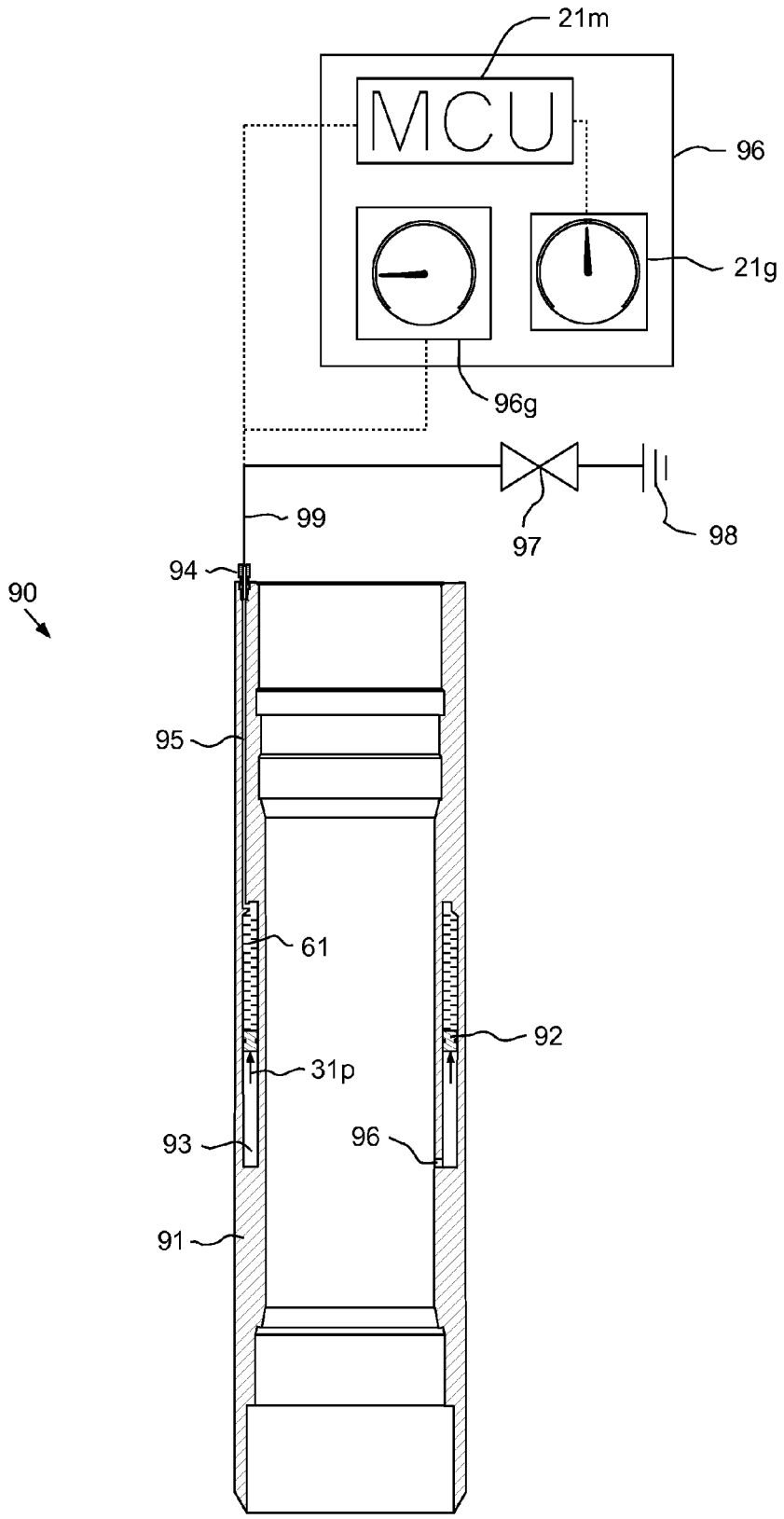
FIG. 5 illustrates a pressure sub for use with either drilling system instead of the isolation valve, according to another embodiment of the present disclosure.

FIG. 5 illustrates a pressure sub 90 for use with either drilling system 1, 70 instead of the isolation valve 50, according to another embodiment of the present disclosure. The pressure sub 90 may be assembled as part of the inner casing string 11 instead of the isolation valve 50.

The pressure sub 90 may include a tubular housing 91 and a pressure responsive element, such as balance piston 92. To facilitate manufacturing and assembly, the housing 91 may include one or more sections (only one section shown) each connected together, such by threaded couplings and/or fasteners. Interfaces between the housing sections may be isolated, such as by seals. The housing sections may include an upper adapter (not shown) and a lower adapter (not shown), each having a threaded coupling, such as a pin or box, for connection to other members of the inner casing string 11. The pressure sub 90 may have a longitudinal bore therethrough for passage of the drill string 5.

The balance piston 92 may carry seals for sealing an interface formed between the piston and the housing 91. A hydraulic chamber 93 may be formed in a wall of the housing 91. Hydraulic fluid 61 may be disposed in an upper portion of the chamber 93. The upper end of the hydraulic chamber 93 may be in fluid communication with a hydraulic coupling 94 via a hydraulic passage 95 formed through the housing wall. A lower end of the hydraulic chamber 56 may be in fluid communication with the annulus 34 via an equalization port 96 formed through the housing wall. The pressure sub 90 may be used with panel 96, shutoff valve 97, and hydraulic reservoir 98 instead of the respective panel 21, manifold 36, and HPU 35. A sensing line 99 may connect the shutoff valve 97 to the hydraulic coupling 94.

The station 96 may include a gauge 96*g*, the MCU 21*m*, and the gauge 21*g* in communication with the MCU 21*m*. The gauge 96*g* be in fluid communication with the sensing line 99 via a pressure tap. The pressure sub 90 may be operated to sense the increased annulus pressure 31*p* in a similar fashion as the isolation valve 50 except that the MCU 21*m* does not need a dynamic correlation to calculate the annulus pressure.

Alternatively, the pressure sensitive element may be a diaphragm instead of the balance piston 92.

Alternatively, for either the isolation valve 50 of the pressure sub 90, the respective HPU/reservoir and manifold/shutoff valve may be assembled as part of the inner casing string 11 such that the respective control/sensing lines do not have to pass through the wellhead 6. The alternative hydraulic system may include a wired or wireless telemetry unit for communication with the technician/PLC on the rig 1*r*.

While the foregoing is directed to embodiments of the present disclosure, other and further embodiments of the disclosure may be devised without departing from the basic scope thereof, and the scope of the present invention is determined by the claims that follow.

The invention claimed is:

1. A method of drilling a wellbore, comprising:

deploying a drill string into the wellbore through a casing string disposed in the wellbore, the casing string having a pressure responsive element responsive to an annulus pressure inside the casing string and a hydraulic line in communication with the element and extending along the casing string;

drilling the wellbore into a formation by injecting drilling fluid through the drill string and rotating a drill bit of the drill sting; and while drilling the formation, monitoring a pressure of the hydraulic line to identify a change in the annulus pressure.

2. The method of claim 1, wherein:

the pressure responsive element is part of an isolation valve, and the hydraulic line is a control line for operating the isolation valve.

3. The method of claim 2, wherein:

the hydraulic control line is configured to open the isolation valve, and the isolation valve is further operated by a second hydraulic control line extending along the casing string configured to close the isolation valve.

4. The method of claim 2, wherein the pressure responsive element is a piston of the isolation valve.

5. The method of claim 2, further comprising:

applying an annulus pressure to the pressure responsive element, wherein the pressure responsive element is a sleeve of the isolation valve; and deflecting the pressure responsive element relative to the wellbore.

6. The method of claim 1, wherein the pressure responsive element is part of a pressure sub.

7. The method of claim 6, wherein the pressure responsive element is a piston of the pressure sub.

8. The method of claim 6, wherein the pressure responsive element is a diaphragm of the pressure sub.

9. The method of claim 6, further comprising:

applying an annulus pressure to the pressure responsive element; and deflecting the pressure responsive element relative to the wellbore.

10. The method of claim 1, further comprising, before drilling the formation, calibrating the pressure responsive element using a hydrostatic pressure of the drilling fluid.

11. The method of claim 10, further comprising, while drilling the formation, converting the monitored pressure to a dynamic annulus pressure.

12. The method of claim 11, further comprising, while drilling the formation, calculating an annulus pressure using the dynamic annulus pressure and the hydrostatic pressure.

13. The method of claim 12, further comprising:

detecting a kick using the calculated annulus pressure; and increasing a density of the drilling fluid to control the kick using the calculated annulus pressure.

14. The method of claim 12, further comprising, while drilling the formation:

measuring a flow rate of the drilling fluid injected into the drill string;

measuring a flow rate of returns;

comparing the returns flow rate to the drilling fluid flow rate; and using the calculated annulus pressure to predict bottom hole pressure.

15. The method of claim 12, further comprising, while drilling the formation, exerting back pressure on the formation using a rotating control device, a variable choke valve, and the calculated annulus pressure.

16. The method of claim 1, wherein the pressure is monitored for a sudden increase to detect a kick.

17. The method of claim 1, wherein the pressure is monitored for a sudden decrease to detect lost circulation.

18. The method of claim 1, further comprising, while deploying the drill string, monitoring the pressure of the hydraulic line.

19. The method of claim 18, further comprising, while deploying the drill string, converting the monitored pressure to a dynamic annulus pressure.

20. The method of claim 19, further comprising, while deploying the drill string, calculating an annulus pressure using the dynamic annulus pressure and a hydrostatic pressure.

* * * * *